US008662192B2

(12) United States Patent
Dunster et al.

(10) Patent No.: US 8,662,192 B2
(45) Date of Patent: Mar. 4, 2014

(54) FIRE AND EXPLOSION SUPPRESSION

(75) Inventors: Robert George Dunster, Slough (GB); Simon James Davies, Staines (GB); Robert James Lade, Marlow (GB)

(73) Assignee: Kidde IP Holding Limited (GB)

( * ) Notice: Subject to any disclaimer, the term of this patent is extended or adjusted under 35 U.S.C. 154(b) by 125 days.

(21) Appl. No.: 10/508,809

(22) PCT Filed: Mar. 28, 2003

(86) PCT No.: PCT/GB03/01394

§ 371 (c)(1),
(2), (4) Date: Apr. 7, 2005

(87) PCT Pub. No.: WO03/082407

PCT Pub. Date: Oct. 9, 2003

(65) Prior Publication Data

US 2005/0173131 A1 Aug. 11, 2005

(30) Foreign Application Priority Data

Mar. 28, 2002 (GB) ..... 0207466.4

(51) Int. Cl.
*A62C 2/00* (2006.01)

(52) U.S. Cl.
USPC ..... 169/44; 169/9; 169/14; 239/303; 239/311; 239/369

(58) Field of Classification Search
USPC ..... 169/9, 11, 14, 15, 20; 239/303, 304, 239/308, 310, 311, 333, 334, 346, 364–366, 239/368, 369, 373; 137/206, 209, 505.14
See application file for complete search history.

(56) References Cited

U.S. PATENT DOCUMENTS 2,560,948 A * 7/1951 Hannibal et al. ..... 137/495
3,342,271 A * 9/1967 Anthony, Jr. ..... 169/15
(Continued)

FOREIGN PATENT DOCUMENTS

EP 0 562 756 A1 3/1993
EP 0 784 998 A2 7/1997
(Continued)

OTHER PUBLICATIONS

Tomas Hudlicky et al. "Practical preparation of potentially anesthetic fluorinated ethyl methyl ethers by means of bromine triflouride and other methods" Journal of Fluorine Chemistry 102 (2000) p. 363-367.

*Primary Examiner* — Jason Boeckmann
(74) *Attorney, Agent, or Firm* — Cantor Colburn LLP

(57) ABSTRACT

A fire and explosion suppression system comprises a source (5) of high pressure water which is fed to a misting nozzle (13) at one input of a mixing unit (6), and a source (14) of high pressure inert gas, such as nitrogen, which is fed along a pipe (20) to another input of the mixing unit (6). Inside the mixing unit (6), water mist, in the form of an atomized mist of very small droplet size is mixed with the pressurized gas and exits the mixing unit (6) at high pressure and high velocity along a pipe (22) and is thence discharged through spreaders (26, 28). The source (5) of the water is pressurized by a feed (30) from the source of pressurized inert gas. The mass flow rate of the water will therefore reduce as the pressure of the gas decays. This tends to maintain the ratio of the mass flow rate of the water to the mass flow rate of the gas constant. This is found to produce and maintain an advantageous distribution of droplet size in the discharged unit. A control unit (10) adjusts a metering valve (7) in dependence on the mass flow rate or the pressure of the gas in order to adjust the ratio as necessary to maintain its value constant.

20 Claims, 4 Drawing Sheets

(56) References Cited

U.S. PATENT DOCUMENTS

| | | | | | |
|---|---|---|---|---|---|
| 4,186,772 | A | | 2/1980 | Handleman | |
| 4,397,422 | A | | 8/1983 | Gwyn | |
| 4,634,050 | A | | 1/1987 | Shippee | |
| 4,981,178 | A | * | 1/1991 | Bundy | 169/9 |
| 5,141,654 | A | | 8/1992 | Fernandez | |
| 5,385,208 | A | | 1/1995 | Baker et al. | |
| 5,759,430 | A | | 6/1998 | Tapscott et al. | |
| 5,799,735 | A | * | 9/1998 | Sundholm | 169/9 |
| 5,845,713 | A | * | 12/1998 | Sundholm | 169/9 |
| 5,845,714 | A | | 12/1998 | Sundholm | |
| 5,845,716 | A | | 12/1998 | Birk | |
| 5,887,662 | A | | 3/1999 | Sundholm | |
| 6,173,790 | B1 | * | 1/2001 | Russwurm et al. | 169/44 |
| 6,223,827 | B1 | * | 5/2001 | Zuev et al. | 169/9 |
| 6,318,474 | B1 | * | 11/2001 | Sundholm | 169/37 |
| 6,346,203 | B1 | | 2/2002 | Robin et al. | |
| 6,390,203 | B1 | * | 5/2002 | Borisov et al. | 169/62 |
| 6,422,320 | B1 | | 7/2002 | Mather et al. | |
| 6,478,240 | B1 | | 11/2002 | Dorkin et al. | |
| 6,935,362 | B1 | * | 8/2005 | Yonnet | 137/489 |

FOREIGN PATENT DOCUMENTS

| | | | | |
|---|---|---|---|---|
| EP | 1 293 230 | A1 | | 9/2001 |
| GB | 1 051 841 | | | 12/1966 |
| GB | 1 306 734 | | | 2/1973 |
| GB | 2 265 309 | A | | 9/1993 |
| GB | 2 375 047 | A | | 6/2002 |
| GB | 2 370 768 | A | | 7/2002 |
| GB | 2 370 766 | A | | 10/2002 |
| GB | 2 370 767 | A | | 10/2002 |
| GB | 2 370 769 | A | | 10/2002 |
| JP | 2000-237339 | | | 9/2000 |
| WO | 95/24274 | | | 9/1995 |
| WO | 95/28204 | | | 10/1995 |
| WO | 96/34660 | | | 11/1996 |
| WO | 97/36651 | A | | 10/1997 |
| WO | 98/09686 | | | 3/1998 |
| WO | 99/38573 | | | 8/1999 |
| WO | WO 99/52643 | | * | 10/1999 |
| WO | 01/05468 | A2 | | 1/2001 |
| WO | 02/078790 | A2 | | 10/2002 |

* cited by examiner

FIRE AND EXPLOSION SUPPRESSION

The invention relates to fire and explosion suppression. Embodiments of the invention, to be described below by way of example only, use a mist of a liquid extinguishant, such as water, as the suppression agent.

According to the invention, there is provided a fire and explosion suppression system, comprising a source of pressurised liquid extinguishing agent, a source of a pressurised inert gas, mist producing means connected to receive a flow of the liquid extinguishing agent to produce a mist therefrom, mixing means for mixing the already-produced mist into a flow of the pressurised inert gas to produce a discharge in the form of a two-phase mixture comprising a suspension of droplets of the mist in the pressurised inert gas, and control means for controlling the ratio of the mass flow rate of the liquid extinguishing agent to the mass flow rate of the pressurised gas towards such a value as to tend to produce a desired droplet size distribution in and for substantially the duration of the discharge.

According to the invention, there is further provided a fire and explosion suppression method, in which a mist of a liquid extinguishing agent is produced from a flow of the liquid extinguishing agent and is mixed into a flow of pressurised inert gas to produce a discharge in the form of a two-phase mixture comprising a suspension of droplets of the mist in the pressurised inert gas, including the step of controlling the ratio of the mass flow rate of the liquid extinguishing agent to the mass flow rate of the pressurised gas towards such a value as to tend to produce a desired droplet size distribution in and for substantially the duration of the discharge.

Fire and explosion suppression systems and methods according to the invention, employing a mist of a liquid extinguishing agent, will now be described, by way of example only, with reference to the accompanying diagrammatic drawings in which.

Figure 1:
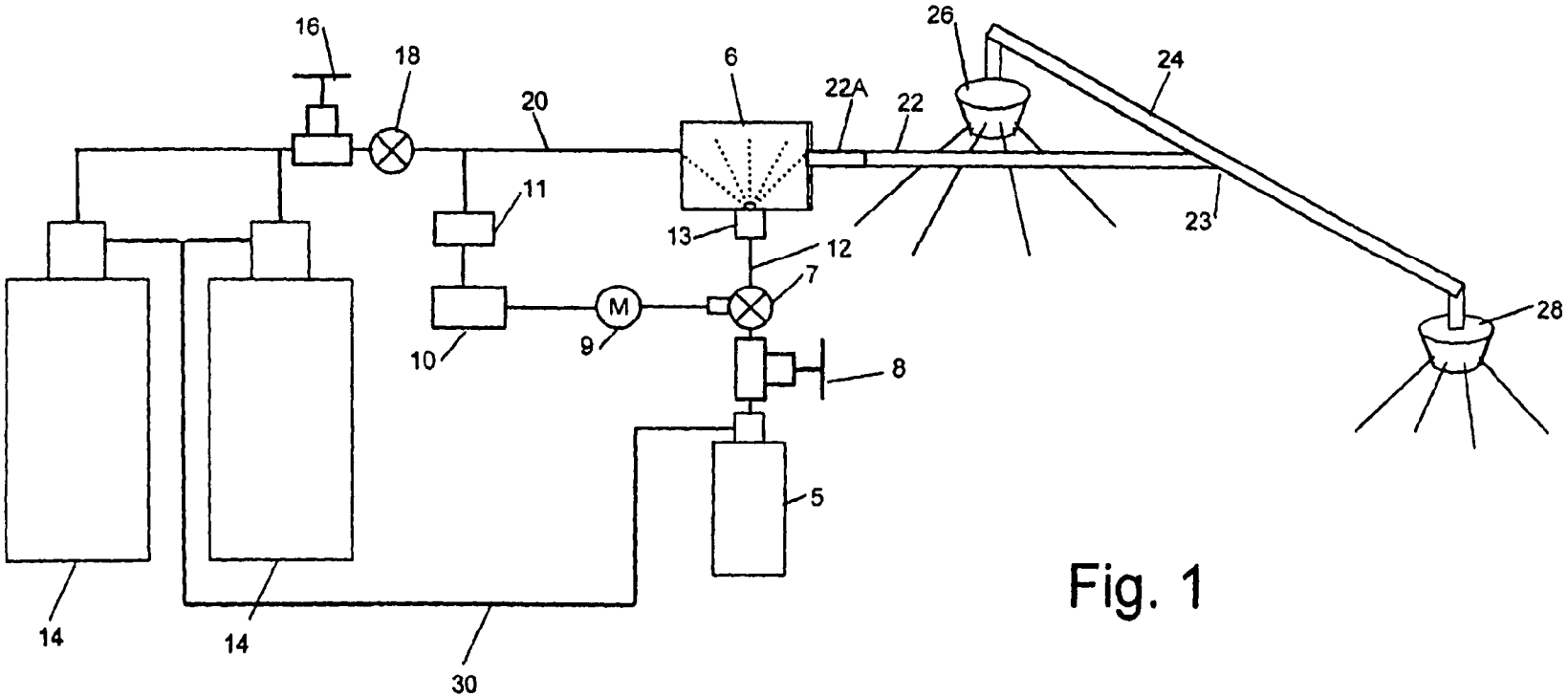
FIG. 1 is a schematic diagram of one of the systems.

Referring to FIG. 1, the system has a vessel 5 storing water. The vessel 5 is connected to an input of a mixing unit 6 via a metering valve 7, a flow regulator 8 and a pipe 12. At the input to the mixing unit 6, the pipe 12 feeds the water to a misting nozzle 13 or other water mist generating means (for example, a simple orifice or restriction hole across which a pressure differential is maintained).

The system also includes a vessel or vessels 14 storing an inert gas such as nitrogen. Vessels 14 have an outlet connected via a means of pressure regulation 16 and/or a means of flow regulation 18 and a pipe 20 to another input of the mixing unit 6. The mixing unit 6 has an outlet pipe 22 which connects with a distribution pipe 24 terminating in spreader or distribution heads 26,28.

The water in the vessel 5 is pressurised by the gas within vessels 14, via an interconnection 30.

The nozzle 13 comprises any suitable form of nozzle for atomising the water to produce a water mist. Examples of suitable misting nozzles include single or multi-orifices, single or multi-orifice phase direct impingement nozzles, spiral insert nozzles and rotating disc nozzles. In principle, any standard water mist type nozzles can be used.

In use, and in response to detection of a fire or explosion, the vessels 5 and 14 are opened. Water from the vessel 5 and gas from the vessels 14 are fed under high pressure through pressure regulators 16 and 8, flow regulator 18 and metering valve 7, and thence along the pipe 12 and 20. The misting nozzle 13 produces a mist of water droplets which is injected into the mixing chamber 6.

In the mixing chamber 6, the water mist produced by the misting nozzle 13 is effectively added to the inert gas received via the pipe 20. The resultant two-phase mixture (that is, water mist droplets carried by the inert gas) exits the mixing chamber along the outlet pipe 22 and is carried at high velocity to a T-junction 23, and thence along the distribution pipe 24 to exit from the spreaders 26,28 into the volume to be protected (that is, the room, enclosure or other space where a fire or explosion is to be suppressed).

Tests have shown that the ratio between the mass flow rate of the water ($M_w$) to the misting nozzle 13 and the mass flow rate of the gas ($M_g$) along the pipe 20 to the mixing chamber 6 is a significant factor for determining the resultant droplet size distribution (DSD) in the mist which is discharged through the spreaders 26,28. If $M_w$ is substantially constant while $M_g$ rapidly decays (as the gas is discharged from the bottles 14), it is found that the median value of DSD increases during the discharge—which is not conducive to good extinguishing performance. It has been found that suitable adjustment of the ratio $M_w/M_g$ can produce a more satisfactory DSD, in particular a value for DSD which is approximately constant for the entirety of the discharge.

In accordance with a feature of the system shown in FIG. 1, the water in the vessel 5 is pressurised by the gas within the vessels 14, via the interconnection 30. Interconnection 30 is shown as connected separately to the two vessels 14. Instead, it could be connected to the pipe which they both feed. The metering valve 7 in the pipe 12 between the vessel 5 and the nozzle 13 enables the initial flow rate of the water in the pipe 12 (that is, the value of $M_w$) to be set. During discharge, the water is forced out of the vessel 5 by the gas pressure in the vessels 14 and passes through the metering valve 7 into the nozzle 13 where it is converted into a mist within the mixing chamber 6. At the same time, the gas is forced along the pipe 20 into the mixing chamber 6. As the gas pressure in the vessels 14 decays, there will clearly be a reduction in the value of $M_w$. At the same time, though, the reduced gas pressure will cause a reduction in the value of $M_g$ in the pipe 20. Approximately, therefore, the ratio of $M_w$ to $M_g$ remains constant throughout the discharge. It is found that DSD remains substantially constant for the entirety of the discharge, and this in turn is found to produce improved fire extinguishing capabilities.

Figure 2:
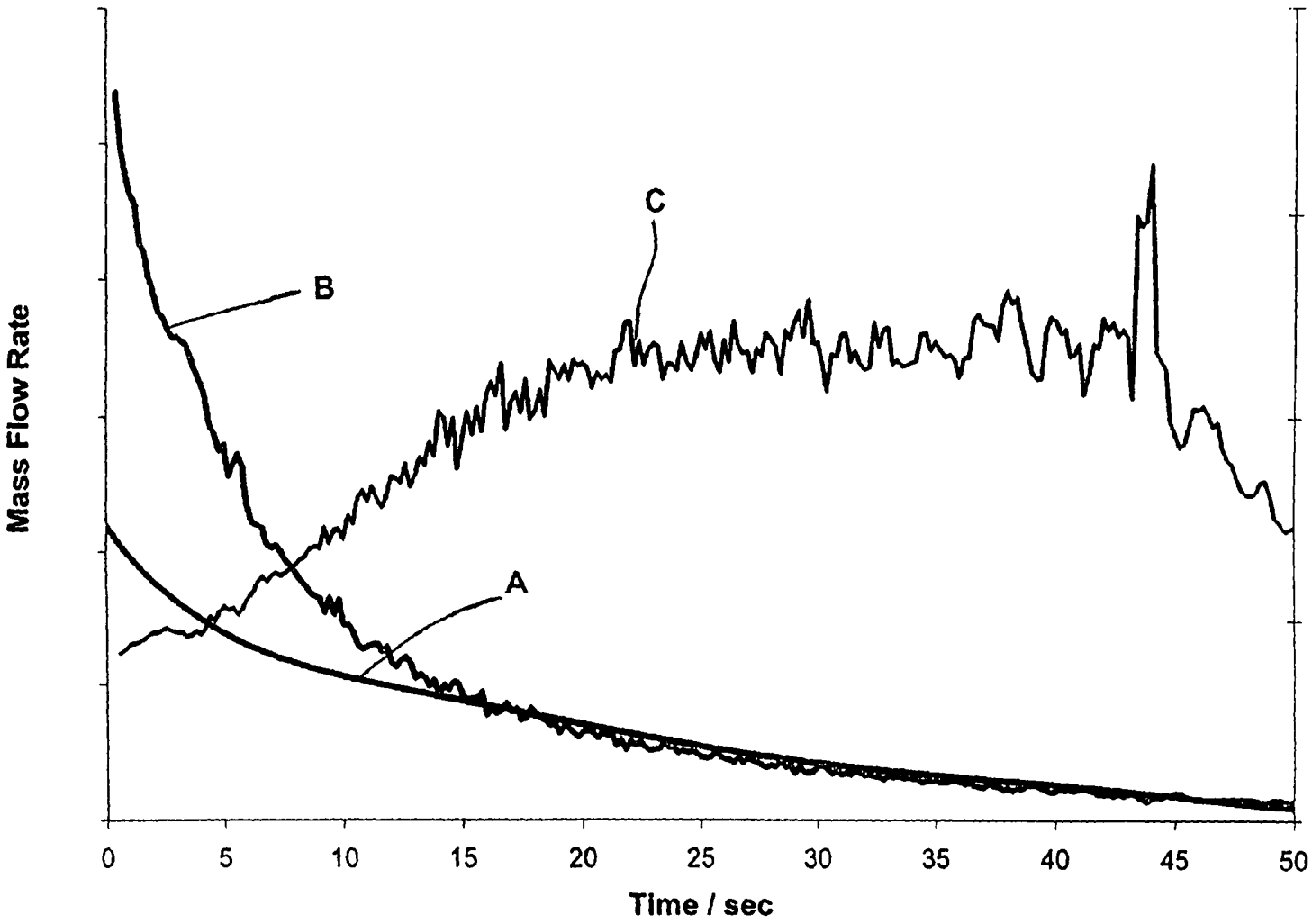
FIG. 2 is a graph for explaining the operation of the system of FIG. 1.

FIG. 2 shows the results of a more detailed investigation into the values of $M_w$ and $M_g$ during discharge. Curve A shows the value of $M_w$, curve B shows the value of $M_g$ and curve C shows the value of the ratio of $M_w/M_g$. Curve C shows that the ratio $M_w/M_g$ is substantially constant for the majority of the discharge. However, there is a significant deviation from constancy during the early stages of the discharge. This suggests that an increase in the value of $M_w$ during the early part of the discharge should be beneficial, because it will raise the value of the ratio $M_w/M_g$ towards a constant value during this part of the discharge. This is found to increase the number of fine water droplets in the discharge and to improve the extinguishing capabilities.

In accordance with a feature of the system shown in FIG. 1, therefore, the flow metering valve 7 is arranged to be dynamically adjustable during the discharge. For example, the metering valve 7 could be a motorised valve driven by an electrical stepper motor 9 under control of a control unit 10. The control unit 10 is responsive to an input dependent on the decaying mass flow rate $M_g$ in the pipe 20 during discharge, receiving an input from a suitable mass flow measuring device 11 (or alternatively receiving an input dependent on decaying pressure in the vessels 14). In a modification not shown, the control unit 10 is pre-programmed with values determined either via a flow prediction model or empirically. The control unit 10 thus energises the stepper motor 9 to achieve a desired value of the ratio $M_w/M_g$ throughout the discharge in order to give a desired value for the DSD.

If a system of the type shown in FIG. 1 is used to protect multiple areas (e.g. multiple rooms), there may be a single water cylinder fed by several gas cylinders. In the event of a fire, the number of gas cylinders activated (that is, opened) will depend on the number of areas or rooms where discharge is required. Thus, the metering valve 7 could be adjusted by the control unit 10 in dependence on the number of activated gas cylinders (and to tend to keep the ratio $M_w/M_g$ constant).

Figure 3:
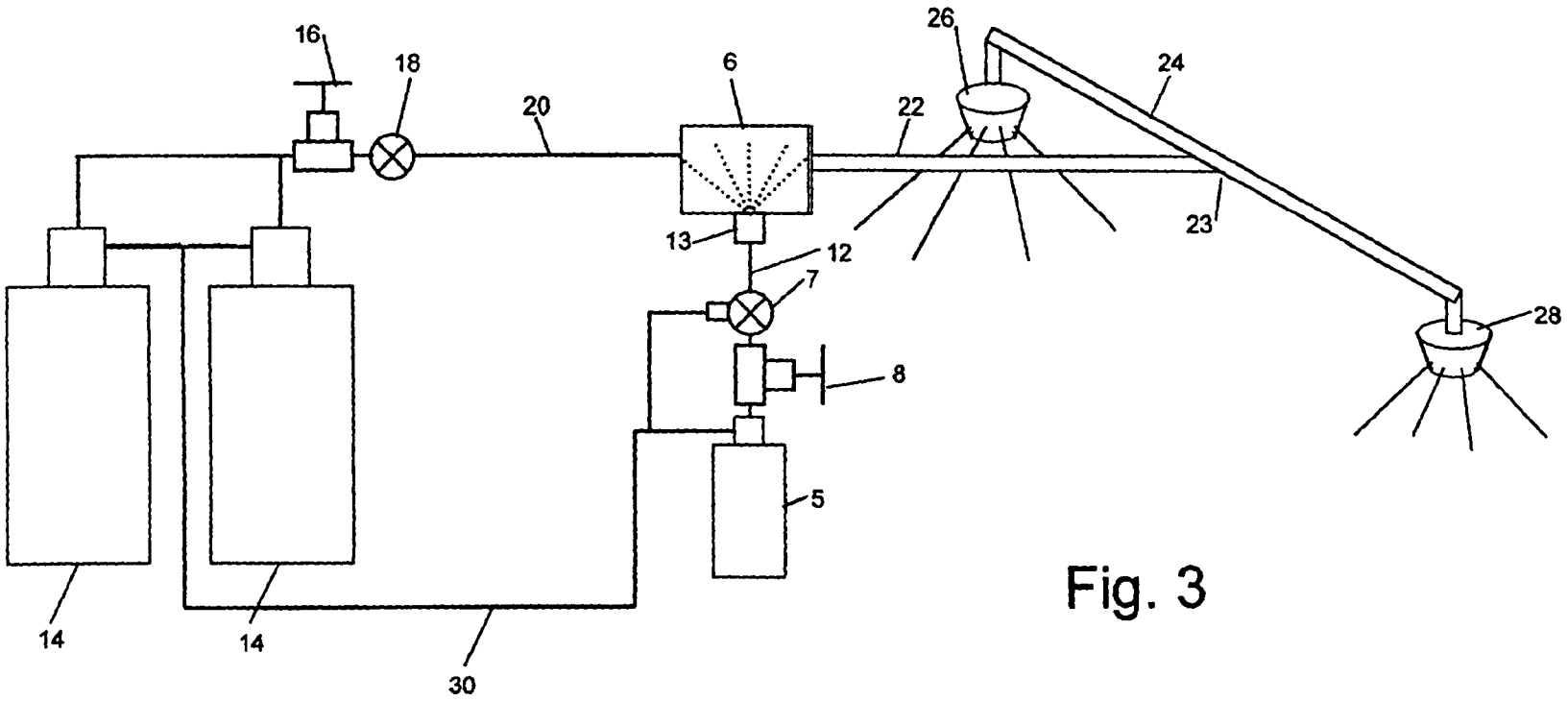
FIG. 3 shows a modification of the system of FIG. 1.

FIG. 3 shows a modification of the system of FIG. 1 in which the metering valve 7 is directly controlled by the pressure in the vessels 14 (via a branch from the interconnection 30). Such a modification avoids the need for the motor 9, the control unit 10 and the measuring device 11. The characteristics of the valve 7 would be selected so that it was adjusted by the decaying gas pressure in such a way as to tend to keep the ratio $M_w/M_g$ constant. In such an arrangement, $M_g$ will be determined by the regulator 18 which will be sonically choked. $M_w$ will be proportional to the square root of the pressure forcing the water out of the vessel 5, that is, the pressure in the interconnection 30. $M_w$ will be directly proportional to the effective size of the varying orifice in the metering valve 7. Thus, if the metering valve 7 is a pressure control proportioning water valve having an orifice size directly controlled by the gas pressure, this will tend to keep the ratio $M_w/M_g$ constant.

Figure 4:
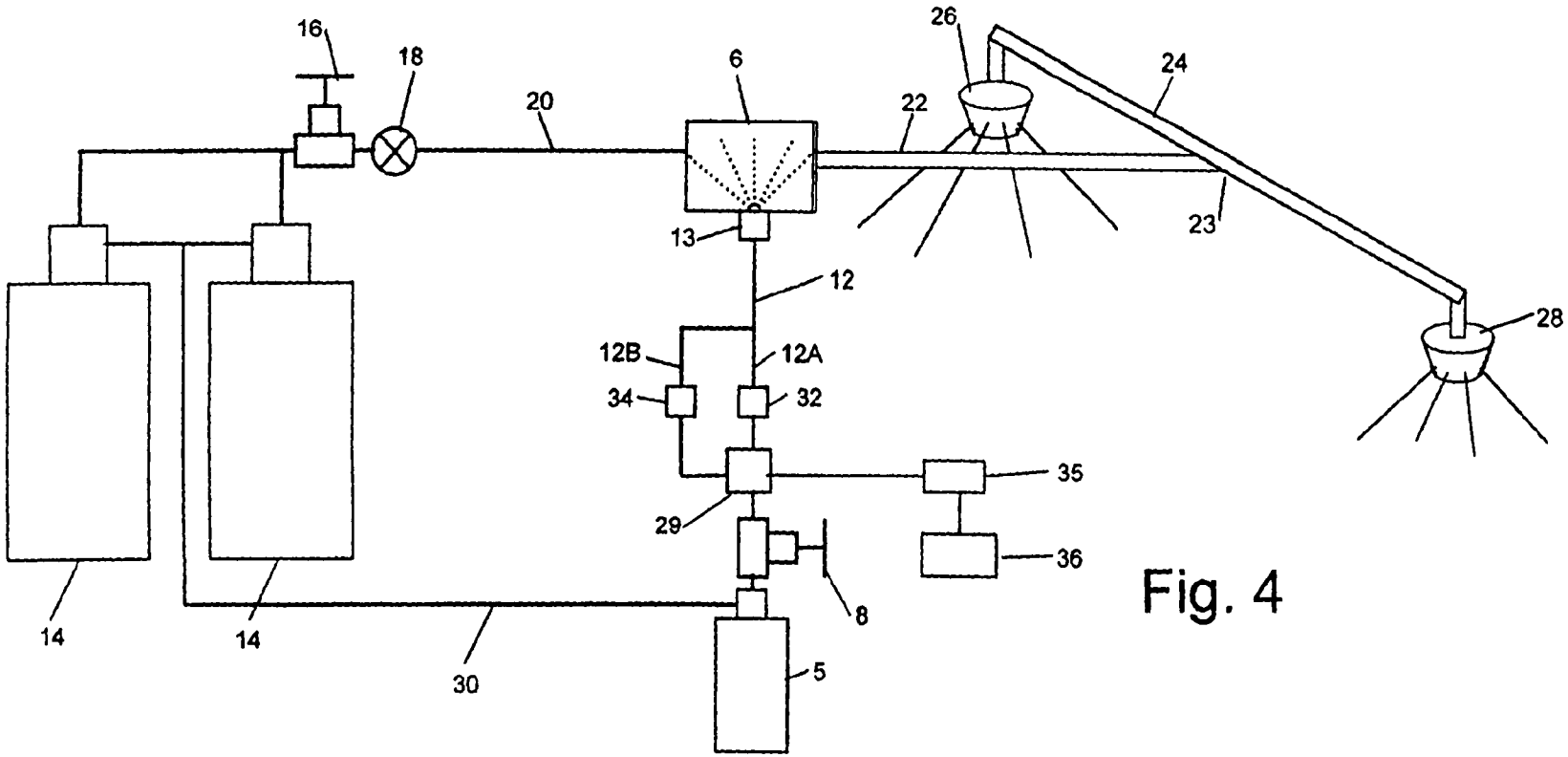
FIG. 4 shows another of the systems.

FIG. 4 shows a modified form of the system of FIG. 1, in which the relative complexity of the continuously variable metering valve 7 of FIG. 1 is avoided. As shown in FIG. 4, the water from the vessel 5 can be fed to the nozzle 13 via either of two pipes 12A and 12B under control of a selector valve 29. In a modification not shown valve 29 comprises two separate selector valves. Pipe 12A incorporates a control orifice 32 having a relatively large open cross-section while pipe 12B incorporates a control orifice 34 having a relatively small open cross-section. In this way, therefore, the selector valve 29 can vary the value for $M_w$ by selecting either the pipe 12A or the pipe 12B to feed the pressurised water to the nozzle 13.

For example, during the early part of discharge, the selector valve 29 will select pipe 12A so that the value for $M_w$ is relatively high. After an initial period, when the pressure in the gas vessels 14 has decreased sufficiently, the selector valve 29 selects pipe 12B instead of 12A.

The selector valve 29 can be operated by an actuator 35 under control of a control unit 36.

The control unit 36 can simply measure the elapsed time since the beginning of discharge, and switch off pipe 12A and switch on pipe 12B instead after a fixed time has elapsed. In a modification (not shown), the control unit could measure the value of $M_g$ in the pipe 20, or the pressure in the gas vessels 14, and switch from pipe 12A to pipe 12B when the measured value has decreased sufficiently.

If two separate selector valves are used, then during the early part of discharge the selector valves will select pipes 12A and 12B so that the combined $M_w$ is relatively high. After an initial period, when the pressure in the gas vessels 14 has decreased sufficiently, the selector valves are set to select pipe 12B only.

Although only two control orifices are shown in FIG. 4, allowing selection between a relatively large open cross-section and a relatively open cross-section, it will be understood that more than two such orifices could be provided, to give a greater number of changes in values of $M_w$.

It has been found that control of the ratio $M_w/M_g$ is difficult at the end of the discharge, and large water droplets may occur which are considered to be undesirable. Therefore, the water flow from the vessel 5 may be stopped completely near the end of the discharge, to allow the remaining gas to remove any water residue present in the pipe network. The water flow could be switched off using the metering valve 7 of FIG. 1 or the selector valve 29 of FIG. 4 (which would have an appropriate intermediate setting). Instead, a separate cut-off valve could be used.

When discharge is initiated, the pressure of the gas within the vessels 14, and the value of $M_g$, decay very rapidly. Tests on a particular installation have shown that 25% of the total mass of the gas has been discharged within two seconds of initiation of the discharge, and 50% of the total mass of the gas has been discharged within seven seconds. Clearly, therefore, it is important to use the first few seconds of discharge as effectively as possible. In accordance with a feature of the systems being described, therefore, vessel 5 can be opened before vessel 14. The pressure of the gas exerted on the water in the vessel 5 via the interconnection 30 will thus ensure that some water is present at the misting nozzle 13 when the gas valve is subsequently opened. This therefore helps to ensure that discharge of water mist through mixing chamber 6 takes place substantially instantaneously upon the opening of vessel 14, to take maximum advantage of the initial gas pressure. Furthermore, the initial presence of the water at the misting nozzle 13, when the flow regulator 18 is opened, helps to reduce problems (e.g. formation of ice) caused by the extremely low temperatures when the gas discharge starts.

It is also believed to be advantageous to ensure that an excess of water is present when discharge starts, to aid wetting of the pipe network. For example, a section 22A of the outlet pipe 22 (see FIG. 1) can be sealed off at each of its ends by a burst disc and filled with water. When discharge starts, the pressure in the pipe 22 bursts the discs, making the trapped water available for pipe wetting.

Although the systems shown in FIGS. 1, 2 and 4 pressurise the water in the vessel 5 using the gas pressure in the vessels 14 (via the interconnection 30), providing an advantageous tendency to a constant ratio of $M_w/M_g$, this method of pressurising the water is not essential. Instead, for example, the water in the vessel 5 could be pressurised in some other suitable way such as by means of a controllable pump. In such a case, a suitable control unit could be used to control the value of $M_w$, by varying the pump pressure, in such a way as to tend to keep the ratio $M_w/M_g$ constant to achieve a desired DSD.

The liquid extinguishant used in the systems as so far described has been specified as water. However, instead, a suitable liquid chemical extinguishant can be used, preferably in the form of a chemical substance having low or zero oxygen depletion potential and a low environmental impact with a short atmospheric lifetime of preferably less than thirty days.

The invention claimed is:

1. A fire and explosion suppression system, comprising:

a source of pressurised liquid extinguishing agent, a source of a pressurised gas, mist producing means connected to receive a flow of the liquid extinguishing agent to produce a mist therefrom, mixing means for mixing the already-produced mist into a flow of the pressurised gas to produce a discharge in the form of a two-phase mixture comprising a suspension of droplets of the mist in the pressurised gas, a first path extending between the source of pressurised liquid extinguishing agent and the mist producing means for guiding the flow of the liquid extinguishing agent to the mist producing means at a mass flow rate thereof, a second path extending between the source of the pressurised gas and the mixing means for guiding the flow of the pressurised gas to the mixing means at a mass flow rate thereof, means for applying a pressure of the pressurised gas to the source of the liquid extinguishing agent, wherein the applied pressure of the pressurised gas continually reduces during the flow thereof through the second path, and means in the first path for automatically adjusting the mass flow rate of the liquid extinguishing agent as a function of the applied pressure of the pressurised gas so as to control the ratio of the mass flow rate of the liquid extinguishing agent in the first path to the mass flow rate of the pressurised gas in the second path towards such a value as to tend to produce a constant droplet size distribution in and for substantially the duration of the discharge, wherein the automatically adjusting comprises automatically reducing the mass flow rate of the liquid extinguishing agent as the applied pressure of the pressurized gas decays over the duration of the discharge.

2. A system according to claim 1, in which the liquid extinguishing agent is water.

3. A system according to claim 1, in which the liquid extinguishing agent is a chemical substance.

4. A system according to claim 1, wherein the pressurised gas is pressurised inert gas.

5. A fire and explosion suppression system, comprising:

a source of pressurised liquid extinguishing agent, a source of a pressurised gas, mist producing means connected to receive a flow of the liquid extinguished agent to produce a mist therefrom, mixing means for mixing the already-produced mist into a flow of the pressurised gas to produce a discharge in the form a two-phase mixture comprising a suspension of droplets of the mist in the pressurised gas, a first path extending between the source of pressurised liquid extinguishing agent and the mist producing means for guiding the flow of the liquid extinguishing agent to the mist producing means at a mass flow rate thereof, a second path extending between the source of the pressurised gas and the mixing means for guiding the flow of the pressurised gas to the mixing means at a mass flow rate thereof, a third path extending between the source of the pressurised gas and the source of the pressurised liquid extinguishing agent for applying a pressure of the pressurised gas to the source of the liquid extinguishing agent, and control means for controlling the ratio of the mass flow rate of the liquid extinguishing agent in the first path to the mass flow rate of the pressurised gas in the second path towards such a value as to tend to produce a constant droplet size distribution in and for substantially the duration of the discharge, wherein the control means includes controllable valve means in the first path for automatically adjusting the mass flow rate of the liquid extinguishing agent in the first path as a function of the pressure of the pressurised gas in the third path during the discharge, and wherein the automatically adjusting comprises automatically reducing the mass flow rate of the liquid extinguishing agent as the applied pressure of the pressurized gas decays over the duration of the discharge.

6. A system according to claim 5, in which the control means includes means for pressurizing the liquid extinguishing agent in dependence on the pressure of the gas.

7. A system according to claim 5, in which the valve means comprises a controllable metering valve means and the control means includes means for adjusting the metering valve means in dependence on the mass flow rate of the gas.

8. A system according to claim 5, in which the valve means comprises a pressure control proportioning water valve having an orifice size directly controlled by the pressure of the pressurised gas in the third path.

9. A system according to claim 5, in which the controllable valve means comprises a plurality of parallel flow paths for feeding the liquid extinguishing agent to the mist producing means and having respective flow orifices of different cross-sectional area, in combination with selection means for selecting any one or more of the flow paths.

10. A system according to claim 5, in which the control means includes means for controlling the pressure of the pressurised liquid extinguishing agent.

11. A system according to claim 10, in which the control means includes a pump for pressurising the source of the liquid extinguishing agent.

12. A system according to claim 11, in which the control means includes means responsive to the mass flow rate of the gas for adjusting the pump to vary the pressure of the source of the liquid extinguishing agent.

13. A fire and explosion suppression system, comprising:

a source of pressurised liquid extinguishing agent, a source of a pressurised gas, mist producing means connected to receive a flow of the liquid extinguishing agent to produce a mist therefrom, mixing means for mixing the already-produced mist into a flow of the pressurised gas to produce a discharge in the form of a two-phase mixture comprising a suspension of droplets of the mist in the pressurised gas, a first path extending between the source of pressurised liquid extinguishing agent and the mist producing means for guiding the flow of the liquid extinguishing agent to the mist producing means at a mass flow rate thereof, a second path extending between the source of the pressurised gas and the mixing means for guiding the flow of the pressurised gas to the mixing means at a mass flow rate thereof, a third path extending between the source of the pressurised gas and the source of the pressurised liquid extinguishing agent for applying a pressure of the pressurised gas to the source of the liquid extinguishing agent, means for controlling the ratio of the mass flow rate of the liquid extinguishing agent in the first path to the mass flow rate of the pressurised gas in the second path towards such a value as to tend to produce a constant droplet size distribution in and for substantially the duration of the discharge including a valve in the first path having a variable orifice controlled by the pressure of the pressurised gas in the third path to adjust the mass flow rate of the liquid extinguishing agent in the first path, wherein the controlling comprises automatically reducing the mass flow rate of the liquid extinguishing agent as the applied pressure of the pressurized gas decays over the duration of the discharge, and means for initiating the flow of the liquid extinguishing agent in the first path before initiating the flow of the pressurised gas in the second path.

14. A fire and explosion suppression method, in which a mist of a liquid extinguishing agent is produced from a flow of the liquid extinguishing agent and is mixed into a flow of pressurised gas to produce a discharge in the form of a two-phase mixture comprising a suspension of droplets of the mist in the pressurised gas, the method including the step of controlling the ratio of the mass flow rate of the liquid extinguishing agent to the mass flow rate of the pressurised gas towards such a value as to tend to produce a constant droplet size distribution in and for substantially the duration of the discharge, wherein the pressurised gas is pressurised by being stored under pressure which thus reduces during the flow thereof and reduces the mass flow rate of the gas, and wherein said controlling of said ratio to produce said constant droplet size distribution in and for substantially the duration of the discharge includes the steps of:

applying the pressure of the stored gas to pressurise the liquid extinguishing agent whereby the reducing applied pressure correspondingly reduces the mass flow rate of the liquid extinguishing agent as the mass flow rate of the gas undergoes said reduction thereof, and directly controlling a valve using the applied pressure of the stored gas to adjust the mass flow rate of the liquid extinguishing agent based on the reducing mass flow rate of the gas.

15. A method according to claim 14, in which the liquid extinguishing agent is water.

16. A method according to claim 14, in which the liquid extinguishing agent is a chemical substance.

17. A method according to claim 14, wherein the pressurised gas is pressurised inert gas.

18. A fire and explosion suppression method, in which a mist of a liquid extinguishing agent is produced from a flow of the liquid extinguishing agent and is mixed into a flow of pressurised gas to produce a discharge in the form of a two-phase mixture comprising a suspension of droplets of the mist in the pressurised gas, the method including the step of controlling the ratio of the mass flow rate of the liquid extinguishing agent to the mass flow rate of the pressurised gas towards such a value as to tend to produce a constant droplet size distribution in and for substantially the duration of the discharge, including the step of initiating an opening of a vessel containing the liquid extinguishing agent before initiating the flow of the gas, and further including the steps of:

applying a pressure of the pressurised gas to pressurise the liquid extinguishing agent, and directly controlling a valve using the applied pressure of the pressurised gas to adjust the mass flow rate of the liquid extinguishing agent, wherein the adjusting comprises automatically reducing the mass flow rate of the liquid extinguishing agent as the applied pressure of the pressurized gas decays over the duration of the discharge.

19. A method for suppressing a fire or an explosion, comprising:

providing a source of an extinguishing liquid and a source of a pressurised extinguishing gas, causing the liquid and the gas to flow simultaneously along a common pipe to a nozzle so that a two-phase mixture comprising droplets of the liquid suspended in the gas is discharged from the nozzle, controlling a ratio of a mass flow rate of the liquid to a mass flow rate of the gas towards a value to produce a desired droplet size distribution in and for substantially a duration of the discharge, wherein the pressurised gas is pressurised by being stored under pressure which reduces during the flow thereof and reduces the mass flow rate of the gas, and applying the pressure of the stored gas to pressurise the liquid and to control a valve for adjusting the mass flow rate of the liquid, whereby the reduced applied pressure adjusts the mass flow rate of the liquid extinguishing agent, wherein the adjusting comprises automatically reducing the mass flow rate of the liquid extinguishing agent as the applied pressure of the pressurized gas decays over the duration of the discharge.

20. A method according to claim 19, wherein the pipe branches to supply the liquid and the gas to a plurality of nozzles.

* * * * *